US011679910B2

(12) United States Patent
Hisanaga

(10) Patent No.: US 11,679,910 B2
(45) Date of Patent: Jun. 20, 2023

(54) PACKAGE BODY FOR CERAMIC SEPARATION MEMBRANE AND PACKAGED ITEM

(71) Applicant: MITSUI E&S MACHINERY CO., LTD., Tokyo (JP)

(72) Inventor: Junji Hisanaga, Osaka (JP)

(73) Assignee: MITSUI E&S MACHINERY CO., LTD., Tokyo (JP)

( * ) Notice: Subject to any disclaimer, the term of this patent is extended or adjusted under 35 U.S.C. 154(b) by 164 days.

(21) Appl. No.: 16/959,699

(22) PCT Filed: May 17, 2019

(86) PCT No.: PCT/JP2019/019768
§ 371 (c)(1),
(2) Date: Jul. 2, 2020

(87) PCT Pub. No.: WO2020/234936
PCT Pub. Date: Nov. 26, 2020

(65) Prior Publication Data

US 2022/0002030 A1 Jan. 6, 2022

(51) Int. Cl.
*B65D 85/62* (2006.01)
*B65D 25/10* (2006.01)
(Continued)

(52) U.S. Cl.
CPC ..... *B65D 25/107* (2013.01); *B65D 5/5047* (2013.01); *B65D 77/26* (2013.01); *B65D 85/20* (2013.01)

(58) Field of Classification Search
CPC .... B65D 5/5047; B65D 25/107; B65D 77/26; B65D 85/20
(Continued)

(56) References Cited

U.S. PATENT DOCUMENTS 3,367,483 A * 2/1968 Studen ..... B65D 81/1075 217/27
3,537,416 A * 11/1970 Cowles ..... F17C 1/002 220/62.19
(Continued)

FOREIGN PATENT DOCUMENTS

CN 202624992 U 12/2012
EP 0341056 A1 11/1989
(Continued)

OTHER PUBLICATIONS

International Search Report dated Aug. 13, 2019 in counterpart PCT application PCT/JP2019/019768, 3 pages in Japanese.
(Continued)

*Primary Examiner* — Luan K Bui
(74) *Attorney, Agent, or Firm* — Juan Carlos A. Marquez; Marquez IP Law Office, PLLC

(57) ABSTRACT

Provided is a package body for ceramic separation membranes, comprising: a packaging box which stores a plurality of ceramic separation membranes in parallel in a width direction and a height direction; and a plurality of partition packs, wherein each of the partition packs has a thickness equal to or larger than a thickness of each of the ceramic separation membranes, and has a plurality of storing parts, with intervals therebetween in the width direction, which are through holes of a size including a projection shape of the ceramic separation membrane, and the packaging box stores at least two kinds of the partition packs stacked in the height direction with the plurality of storing parts arranged in the width direction in a staggered manner.

8 Claims, 9 Drawing Sheets

(51) Int. Cl.
*B65D 5/50* (2006.01)
*B65D 77/26* (2006.01)
*B65D 85/20* (2006.01)

(58) Field of Classification Search
USPC ..... 206/499, 503, 561, 564, 725
See application file for complete search history.

(56) References Cited

U.S. PATENT DOCUMENTS 3,591,032 A * 7/1971 Baxter ..... B65D 71/70 206/386
4,884,684 A * 12/1989 Bernardin ..... B65D 81/1075 206/592
7,121,408 B2 * 10/2006 Wilson ..... B65D 71/70 206/509
7,870,957 B2 * 1/2011 Holley, Jr. ..... B65D 5/724 206/427
8,109,389 B1 * 2/2012 Amer ..... B65D 5/5038 220/23.88
2003/0121819 A1 * 7/2003 Zheng ..... B65D 25/107 206/499
2016/0058182 A1 * 3/2016 Langston ..... A47B 47/0091 211/85.18
2018/0288961 A1 * 10/2018 Foght ..... A01J 25/13

FOREIGN PATENT DOCUMENTS

| | | | |
|---|---|---|---|
| JP | 57-137159 | | 8/1982 |
| JP | 63-171376 | | 11/1988 |
| JP | 2004-217277 | A | 8/2004 |
| JP | 2007269345 | A | 10/2007 |
| JP | 2015054723 | A | 3/2015 |
| JP | 2016067992 | A | 5/2016 |
| JP | 2019108132 | A | 7/2019 |

OTHER PUBLICATIONS

Supplementary European Search Report dated Feb. 9, 2022 in counterpart EP application 19929672.4, 7 pages in English.

* cited by examiner

〔Fig. 1〕
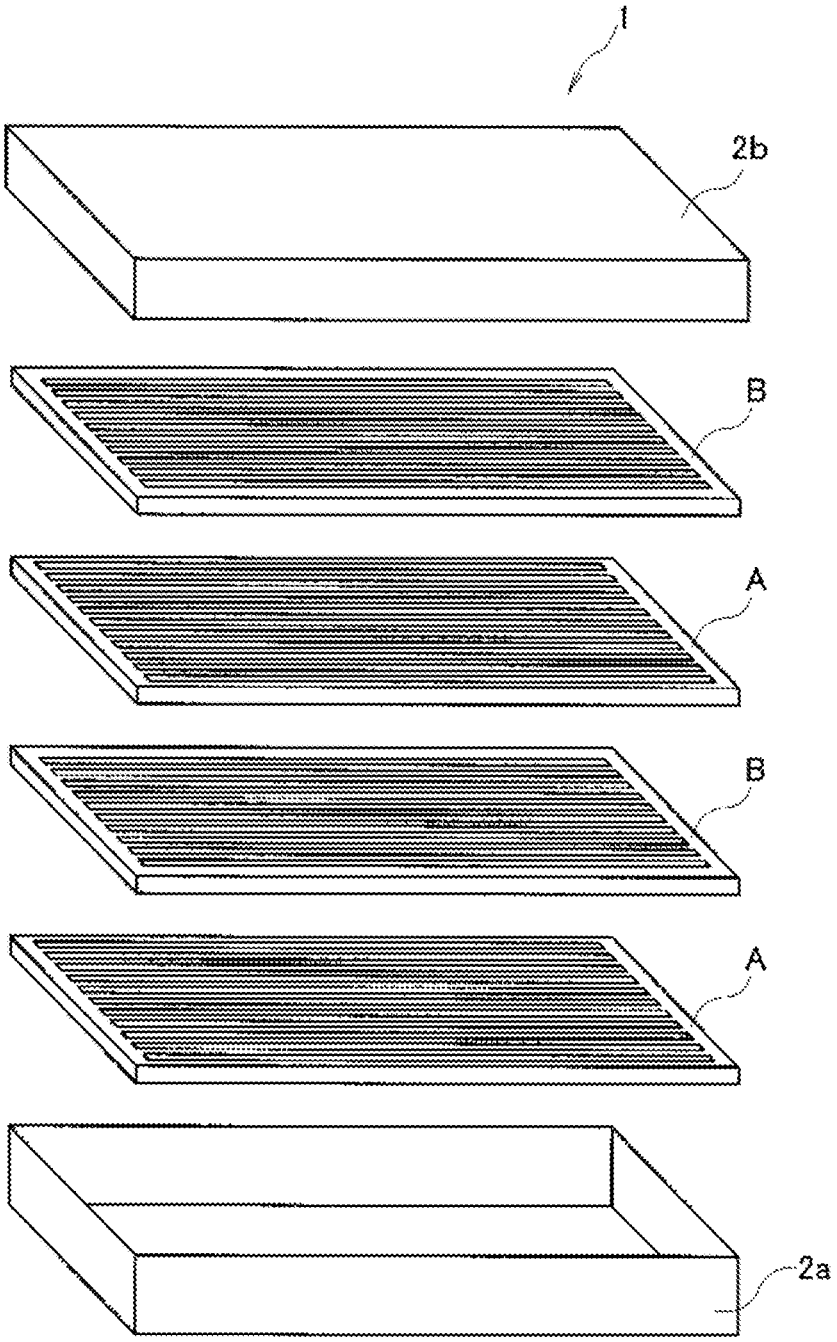

〔Fig.2〕
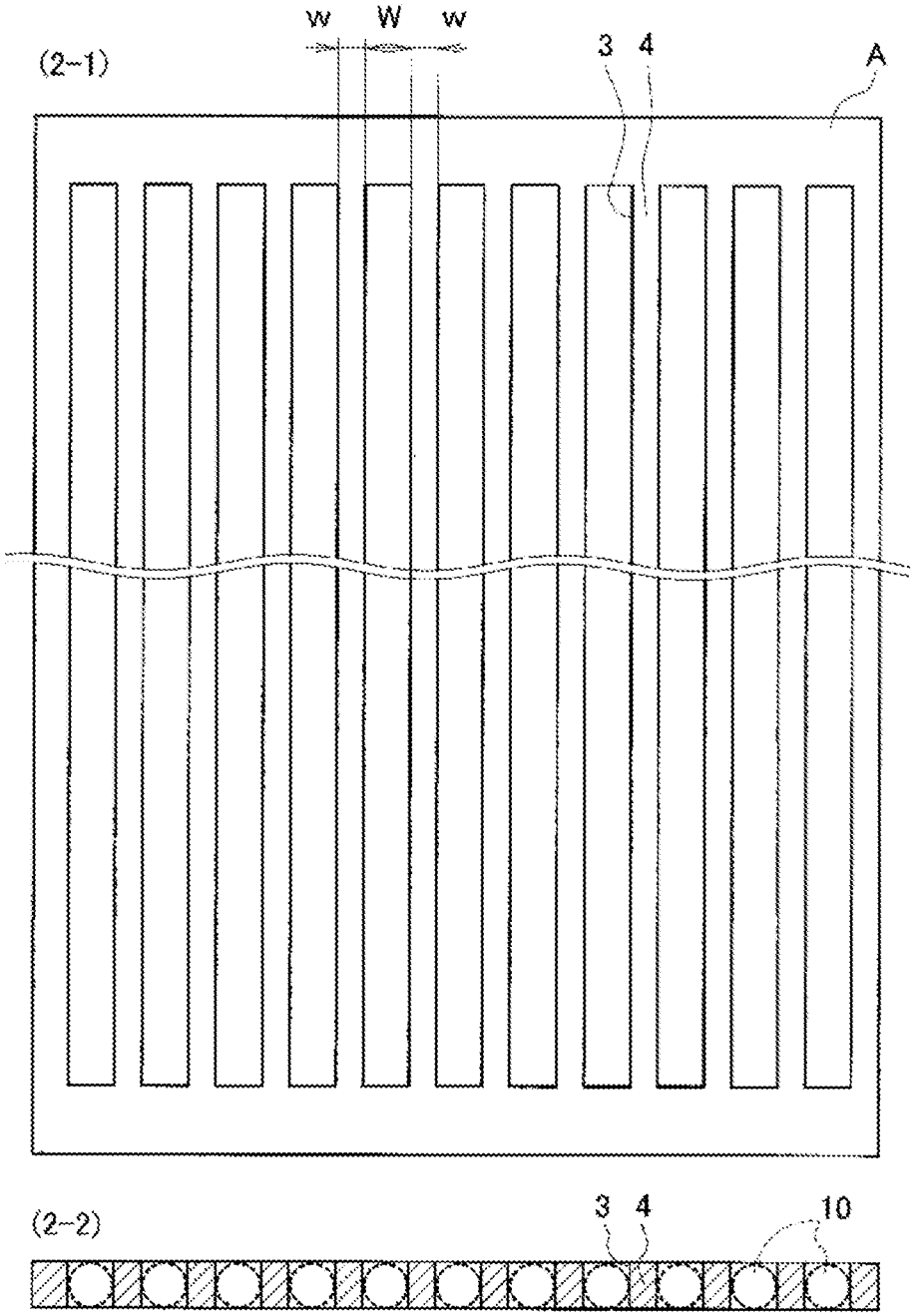

〔Fig.3〕
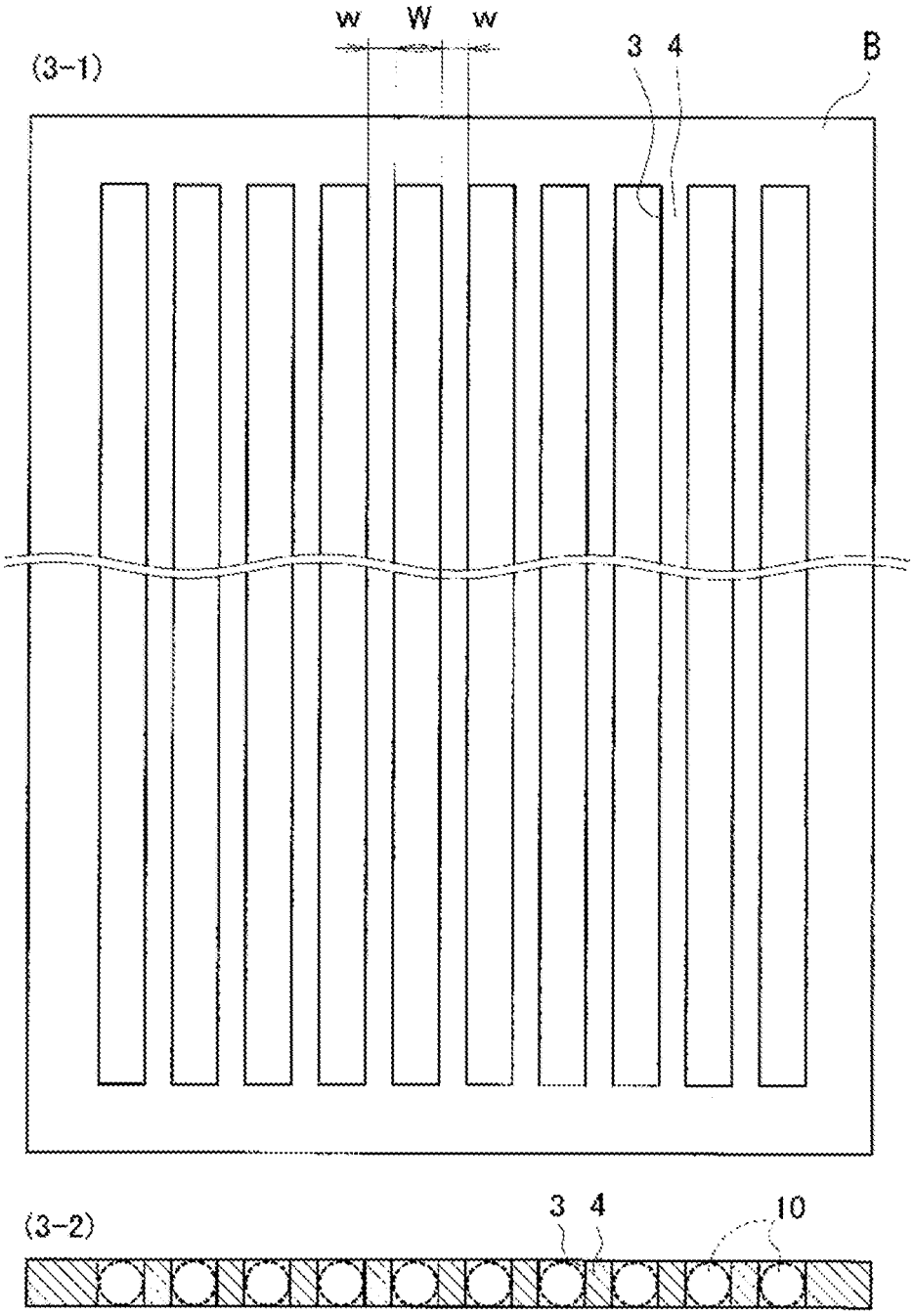

〔Fig.4〕
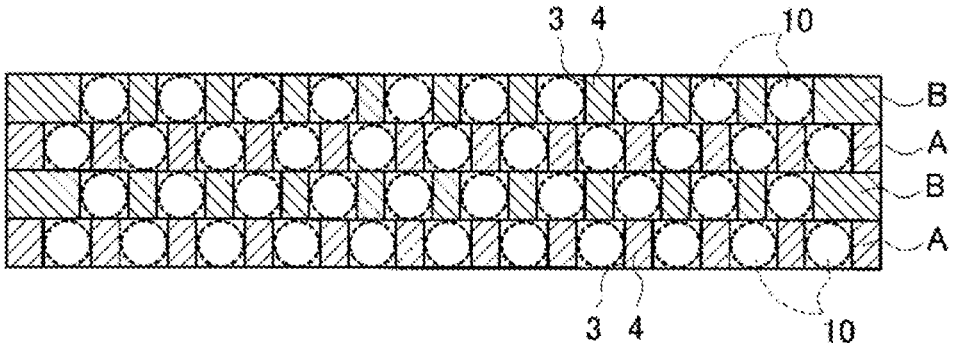

〔Fig.5〕
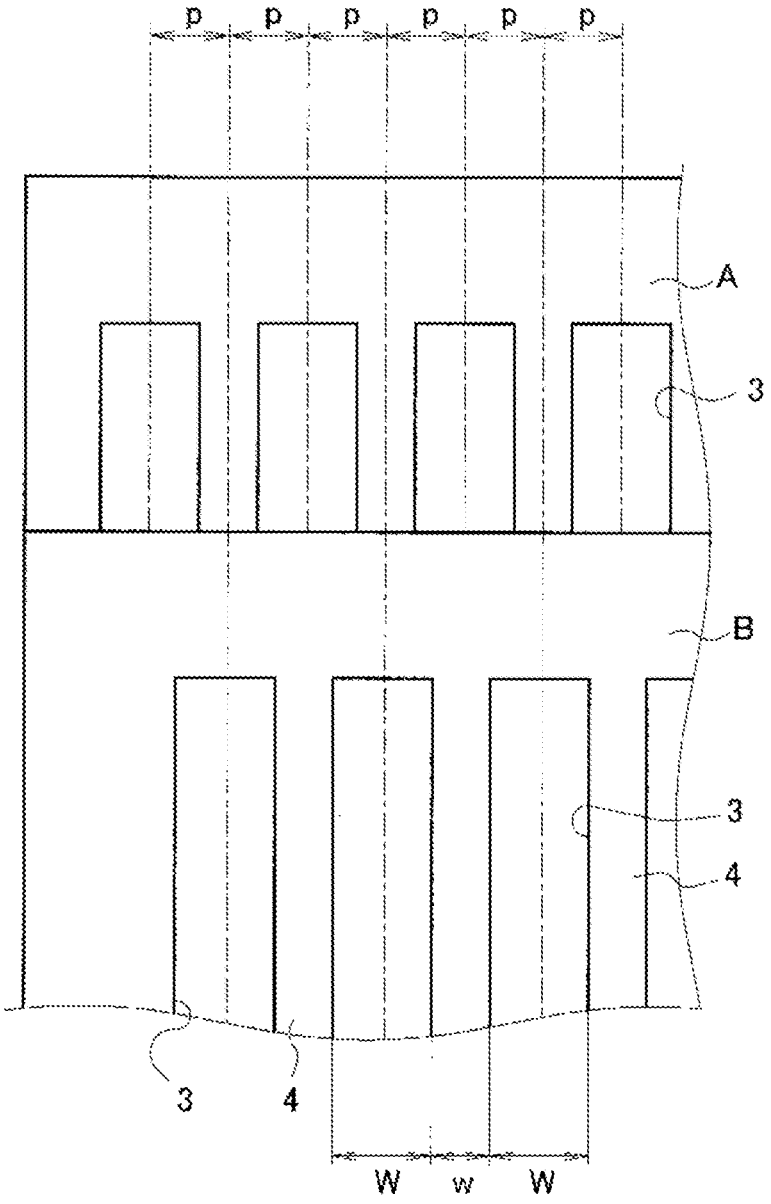

〔Fig.6〕
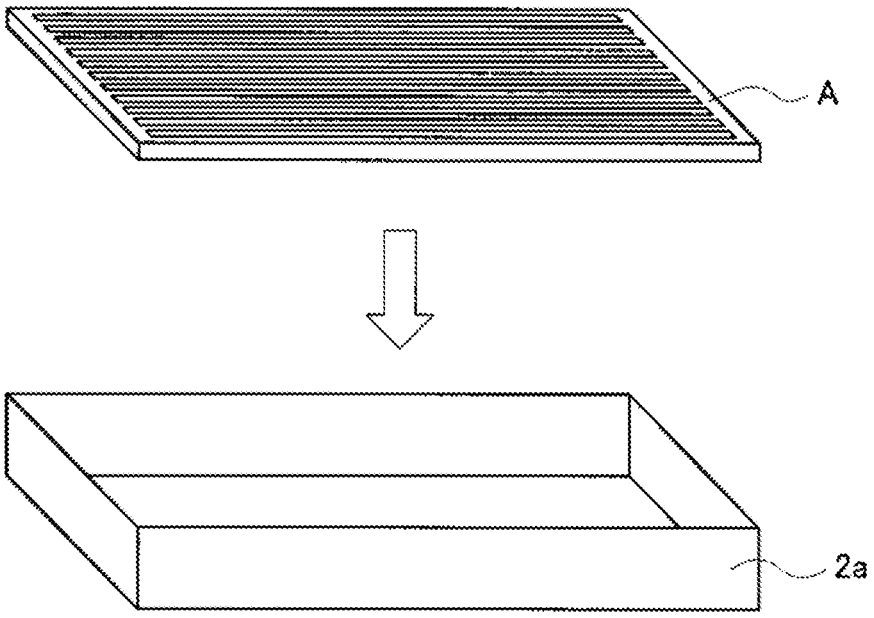
〔Fig.7〕
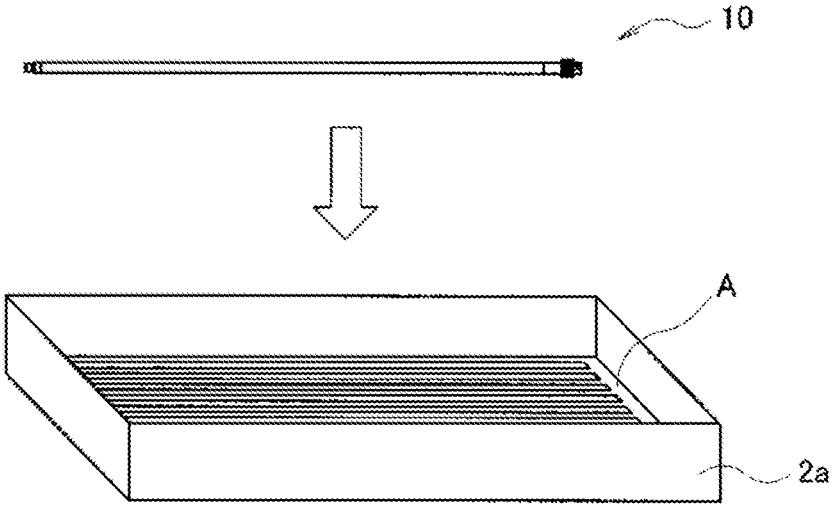

〔Fig.8〕
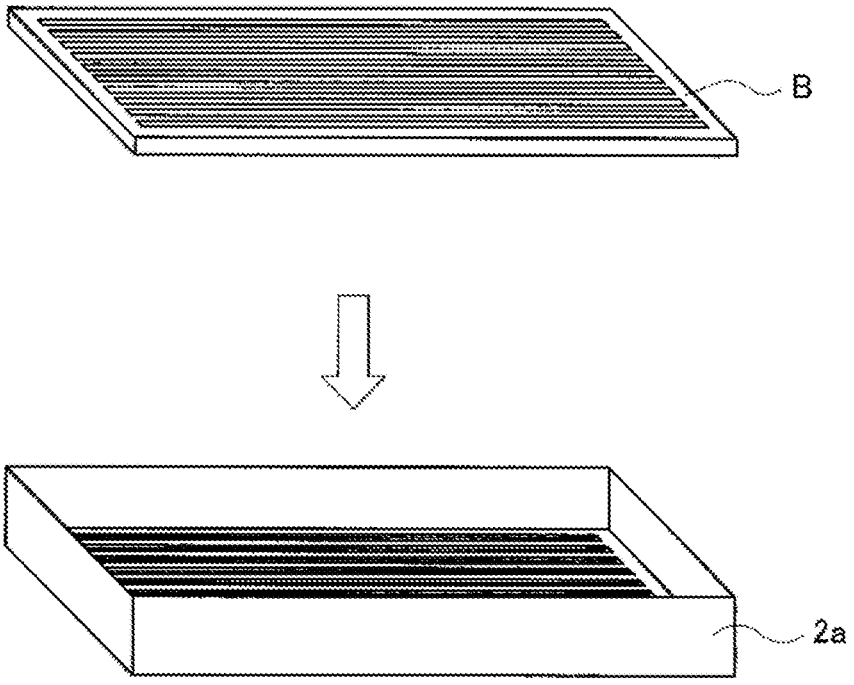
〔Fig.9〕
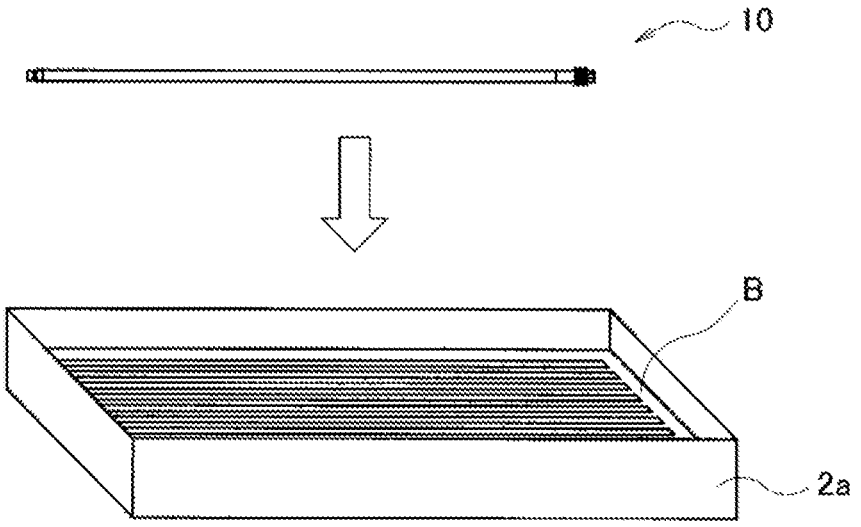

〔Fig.10〕
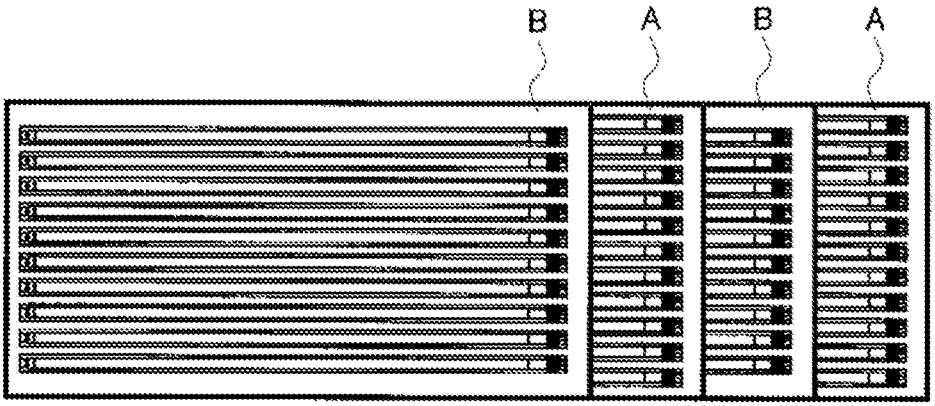
〔Fig.11〕
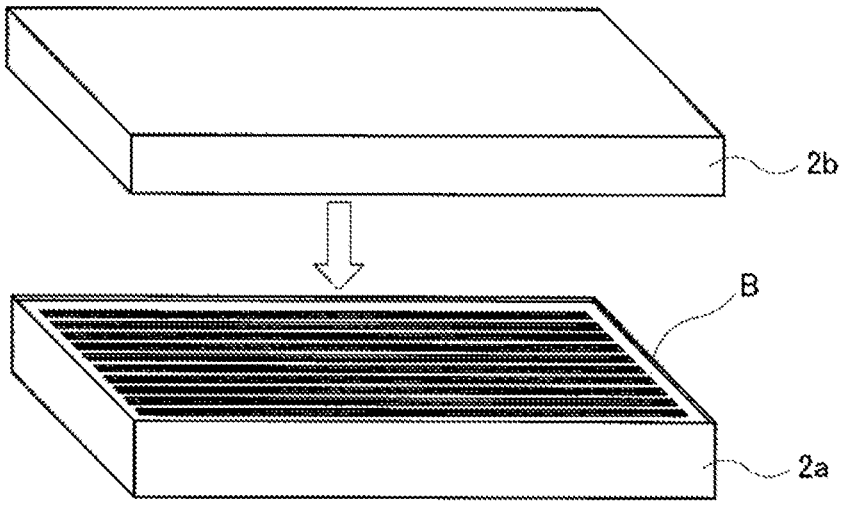

〔Fig.12〕
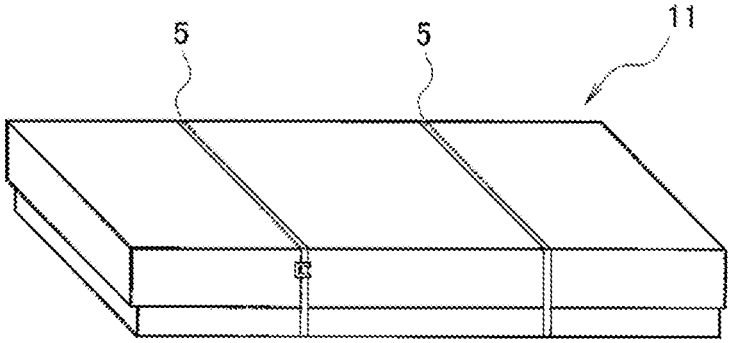

PACKAGE BODY FOR CERAMIC SEPARATION MEMBRANE AND PACKAGED ITEM

TECHNICAL FIELD

The present invention relates to a package body for ceramic separation membranes which efficiently stores ceramic separation membranes without damaging them, and a packaged item thereof.

BACKGROUND ART

In recent years, apparatuses using ceramic separation membranes such as zeolite membranes have been actively employed as means for separating water from bioethanol to produce high-purity ethanol, means for purifying and refining water, or means for separating insoluble solid components. Since the ceramic separation membrane is easily damaged by impact or the like, and its functions may be impaired by surface contamination or the like, care must be taken in its preservation and transportation. Conventionally, in the case of exporting ceramic separation membranes overseas, the ceramic separation membranes are rolled using a bubble wrap or the like for the purpose of avoiding contact and packed in inner boxes, and multiple inner boxes are put together in an outer box, and further the outer box is put in a wooden box, stored in a container, and transported.

However, it cannot be necessarily said that rolling ceramic separation membranes is efficient packaging means because it takes effort to do so, and it is also necessary to accurately manage the number of rolls stored in the inner boxes. In addition, when the ceramic separation membranes are rolled, or when the ceramic separation membrane are taken out of the rolled pack, the ceramic separation membranes may come into contact with the outside or the ceramic separation membranes may come into contact with each other, and the ceramic separation membranes may be damaged in their surfaces and may no longer be used.

Patent Document 1 proposes a packaging box used for a membrane module having a flat membrane type separation membrane and a water collecting pipe. However, this packaging box cannot be applied to a cylindrical ceramic separation membrane having a significantly different shape, and there is a need for a package body for ceramic separation membranes which efficiently stores more ceramic separation membranes without damaging them.

PRIOR ART DOCUMENT

Patent Document

Patent Document 1: Japanese patent application Kokai publication No. 2004-217277

SUMMARY OF THE INVENTION

Problem to be Solved by the Invention

An object of the present invention is to provide a packaging box which efficiently stores multiple ceramic separation membranes without damaging them.

Means for Solving the Problem

A package body for ceramic separation membranes of the present invention which achieves the above object is a package body including a packaging box which stores a plurality of ceramic separation membranes in parallel in a width direction and a height direction, and a plurality of partition packs. Here, each of the partition packs has a thickness equal to or larger than a thickness of each of the ceramic separation membranes, and has a plurality of storing parts, with intervals therebetween in the width direction, which are through holes of a size including a projection shape of the ceramic separation membrane, and the packaging box stores at least two kinds of the partition packs stacked in the height direction with the plurality of storing parts arranged in the width direction in a staggered manner.

Effects of the Invention

The package body for ceramic separation membranes of the present invention includes partition packs A and B stacked in the height direction with multiple storing parts arranged in the width direction in a staggered manner. Thus, when ceramic separation membranes are stored in the storing parts, the ceramic separation membranes adjacent in the width direction and the height direction do not come into contact with each other. Therefore, the ceramic separation membranes can be protected from damage, and can be efficiently stored and taken out.

Assuming that the number of storing parts of partition pack A placed at a bottom of the packaging box is n, it is preferable that the number of storing parts of partition pack B placed on partition pack A be (n−1), and it is further preferable that partition pack A be placed at an odd-numbered stage and partition pack B be placed at an even-numbered stage counted from the bottom of the packaging box. This makes it possible to stably store the ceramic separation membranes in the packaging box.

It is preferable that center lines of the storing parts of partition pack A and center lines of the storing parts of partition pack B be arranged at substantially equal intervals in the width direction. This makes it possible to reduce the contact between the ceramic separation membranes stored in partition pack A and the ceramic separation membranes stored in partition pack B.

It is preferable that the ceramic separation membrane be a cylindrical separation membrane having a diameter of D, and each of the intervals between the plurality of storing parts arranged substantially parallel to the width direction is D/2 or more and D or less. This makes it possible to efficiently store the ceramic separation membranes, and to hold the ceramic separation membranes stored on the partition walls between the adjacent storing parts.

A packaged item of the present invention comprises: a plurality of ceramic separation membranes stored in the package body for ceramic separation membranes described above, wherein the ceramic separation membranes adjacent in the width direction and the height direction are arranged to avoid contact with each other. Therefore, the ceramic separation membranes can be protected from damage, and can be efficiently stored and taken out.

BRIEF DESCRIPTION OF THE DRAWINGS

FIG. 1 is an explanatory diagram illustrating an example of an embodiment of a package body for ceramic separation membranes of the present invention.

FIG. 2 is a top view (2-1) and a side cross-sectional view (2-2) illustrating a partition pack A constituting the package body for ceramic separation membranes of the present invention.

FIG. 3 is a top view (3-1) and a side cross-sectional view (3-2) illustrating a partition pack B constituting the package body for ceramic separation membranes of the present invention.

FIG. 4 is a cross-sectional view illustrating an embodiment in which the partition packs A and B depicted in FIGS. 2 and 3 are stacked.

FIG. 5 is a is a partially enlarged view illustrating an embodiment in which the partition packs A and B depicted in FIGS. 2 and 3 are stacked in a manner staggered in the length direction.

FIG. 6 is a schematic diagram of placing the partition pack A on the main body of the packaging box.

FIG. 7 is a schematic diagram of storing a ceramic separation membrane in the partition pack A in the box main body.

FIG. 8 is a schematic diagram of placing the partition pack B on the partition pack A in the box main body.

FIG. 9 is a schematic diagram of storing a ceramic separation membrane in the partition pack B in the box main body.

FIG. 10 is a schematic diagram in which the partition packs A and B storing ceramic separation membranes are alternately stacked.

FIG. 11 is a schematic diagram in which a lid is fitted to the box main body storing ceramic separation membranes.

FIG. 12 is a schematic diagram illustrating an example of an embodiment of a packaged item storing ceramic separation membranes.

MODES FOR CARRYING OUT THE INVENTION

The package body for ceramic separation membranes of the present invention includes a packaging box and multiple partition packs, and stores multiple ceramic separation membranes in parallel in the width direction the height direction. FIG. 1 is an explanatory diagram illustrating an example of an embodiment of a package body for ceramic separation membranes. The package body 1 for ceramic separation membranes includes packaging boxes 2*a* and 2*b* and multiple partition packs A and B. In the example of FIG. 1, the packaging boxes 2*a* and 2*b* include a main body 2*a* and a lid 2*b* of the packaging boxes. The form of the lid 2*b* is not limited to the example of FIG. 1, and the fitting with the main body 2*a* may be deep or shallow. In addition the main body 2*a* and the lid 2*b* of the packaging boxes may be separated as illustrated in the figure, or at least a part thereof may be joined. For example, the lid 2*b* may be formed by folding extending portions inwardly, the extending portions upwardly extending independently from the four wall portions of the main body 2*a* of the packaging box. The packaging boxes 2*a* and 2*b* can preferably be made of corrugated fiberboard.

In FIG. 1, the partition pack A, the partition pack B, the partition pack A, and the partition pack B are stored in this order in the main body 2*a* of the packaging box (hereinafter sometimes referred to as the "box main body"), and the lid 2*b* of the packaging box is fitted, thereby forming a package body 1 for ceramic separation membranes. Note that the number of partition packs is plural, preferably 2 to 6, and more preferably 3 to 5.

The two kinds of partition packs A and B have a thickness equal to or larger than the thickness of the ceramic separation membrane, and include, as exemplified in FIGS. 2 and 3, multiple storing parts 3, with intervals therebetween in the width direction, which are through holes of a size including the projection shape of the ceramic separation membrane. In addition, in the two kinds of partition packs A and B, multiple storing parts are arranged in the width direction in a staggered manner. The thickness of the partition packs A and B is equal to or larger than the thickness of the ceramic separation membrane, and can be preferably about 0.1 to 3 mm, and more preferably about 0.2 to 2 mm thicker than the thickness of the ceramic separation membrane. Thereby, when the partition packs A and B are alternately stacked and a ceramic separation membrane is stored in each of the storing parts 3, it is possible to suppress the deflection of the partition packs A and B due to the weight of the ceramic separation membranes. The material of the partition packs A and B is not particularly limited, and examples thereof include a corrugated fiberboard, a foam-molded article made of foamed resin, and the like.

Each of the partition packs A and B has multiple storing parts 3 for storing ceramic separation membranes at intervals in the width direction. The storing part 3 is formed of a through hole of a size including the projection shape of the ceramic separation membrane. Here, the projection shape of the ceramic separation membrane is a shape projected from above in the vertical direction on the surfaces of the partition packs A and B, and the through hole of a size including the projection shape refers to a through hole having the projection shape itself or a simple-shaped through hole including the projection shape. The through hole may be vertically penetrated while keeping the size including the projection shape, or a part of the shape including the projection shape may be penetrated. In addition, the through hole is preferably of a size that holds the stored ceramic separation membrane prevents excessive swing during transportation. For example, the cross-sectional shape of the through hole may be along the cross-sectional shape below the maximum diameter portion of the ceramic separation membrane. The illustrated storing parts are each formed of a long and narrow rectangular through hole including the projection shape of the ceramic separation membrane, but as described above, the form of the storing parts is not limited to this example.

In FIG. 2, FIG. 2-1 is a top view of the partition pack A, and FIG. 2-2 is a cross-sectional view thereof. The cross-sectional view of FIG. 2-2 is a virtual view in which eleven ceramic separation membranes 10 are stored. Similarly, in FIG. 3, FIG. 3-1 is a top view of the partition pack B, and FIG. 3-2 is a cross-sectional view thereof. The cross-sectional view of FIG. 3-2 is a virtual view in which ten ceramic separation membranes 10 are stored. As described above, the partition packs A and B have the storing parts 3 and the partition walls 4 arranged in parallel in the width direction.

The width W of the storing part has a size equal to or larger than the diameter D of the cylindrical ceramic separation membrane, and can be larger than the diameter D by preferably 0.1 to 3 mm, and more preferably 0.2 to 2 mm. Each of the partition walls 4 is a wall portion that partitions between adjacent storing parts arranged substantially parallel to the width direction, and the width w of the partition wall 4, that is, the interval between adjacent storing parts 4 is preferably D/2 or more and D or less, and more preferably 0.7 D or more and 0.9 D or less. When the width w of the partition wall 4 is set in such a range, the ceramic separation membrane can be efficiently stored and the ceramic separation membrane stored on the partition wall 4 can be held.

In the two types of partition packs A and B, multiple storing parts 4 are arranged in the width direction in a staggered manner. As exemplified in FIG. 4, by alternately stacking the two types of partition packs A and B with the storing parts 4 arranged in a staggered manner, it is possible to prevent mutual contact of the ceramic separation membranes adjacent in the width direction and the height direction when the ceramic separation membranes are stored in the storing parts. This makes it possible to suppress damage to the ceramic separation membranes. In addition, the ceramic separation membranes can be efficiently stored in the packaging box, and can be safely preserved, transported, and taken out.

In the partition packs A and B, the number of storing parts may be the same or different. Preferably, the number of partition packs placed on the lower side is larger than the number of partition packs placed on the upper side. For example, assuming that the number of storing parts of the partition pack A placed at the bottom of the packaging box is n, it is preferable that the number of storing parts of the partition pack B placed on the partition pack A be (n−1). This makes it possible to stably store the ceramic separation membranes in the packaging box.

It is further preferable that the partition pack A be placed at an odd-numbered stage and the partition pack B be placed at an even-numbered stage counted from the bottom of the packaging box. As illustrated in FIG. 4, when the partition pack A having a large number of storing parts, 11, is placed at the first and third stages, and the partition pack B having a small number of storing parts, 10, is placed at the second and fourth stages, the ceramic separation membranes can be stably stored and can be more efficiently stored in the packaging box.

In the partition packs A and B, preferably, the storing parts 3 are arranged such that the center lines of the storing parts of the partition pack A and the center lines of the storing parts of the partition pack B are at substantially equal intervals in the width direction. For example, as exemplified in FIG. 5, when the partition packs A and B are stacked with the width direction aligned, it is preferable that the intervals between the center lines of the storing parts of the partition pack A and the center lines of the storing parts of the partition pack B are equal to the distance p in the width direction. As above, when the partition pack B is placed on the partition pack A, the center lines of the partition walls 4 of the partition pack A coincide with the center lines of the storing parts of the partition pack B. Thus, the ceramic separation membranes stored in the storing parts of the partition pack B can be reliably supported on the upper surfaces of the partition walls 4 of the partition pack A. Likewise, when the partition pack A is placed on the partition pack B, the center lines of the partition walls 4 of the partition pack B coincide with the center lines of the storing parts of the partition pack A. Thus, the ceramic separation membranes stored in the storing parts of the partition pack A can be reliably supported on the upper surfaces of the partition walls 4 of the partition pack B.

Next, description is provided for a packaging method for storing ceramic separation membranes in the package body for ceramic separation membranes of the present invention. FIG. 6 is a schematic diagram of placing the partition pack A on the main body 2*a* of the packaging box. Note that, prior to placing the partition pack A, a cushioning material may be placed at the bottom of the main body 2*a* of the packaging box.

FIG. 7 is a schematic diagram of storing the ceramic separation membrane 10 in the storing part 4 of the partition pack A placed in the box main body 2*a* of FIG. 6. In the illustrated example, eleven ceramic separation membranes 10 can be stored in the partition pack A. Compared to the conventional operation of rolling and storing the ceramic separation membrane 10, the number stored can be easily managed with less labor, and the product can be stored efficiently and without damaging the product.

FIG. 8 is a schematic diagram of placing the partition pack B on the partition pack A storing the ceramic separation membranes 10 of FIG. 7. Here, the partition wall 4 of the partition pack B is located on the ceramic separation membrane stored in the storing part 3 of the partition pack A. Therefore, it is possible to protect the ceramic separation membranes 10 stored in the partition pack A.

FIG. 9 is a schematic diagram of storing the ceramic separation membrane 10 in the storing part 4 of the partition pack B placed in the box main body 2*a* of FIG. 8. In the illustrated example, ten ceramic separation membranes 10 can be stored in the partition pack B. Hereinafter, similarly, the partition pack A is placed on the partition pack B storing the ceramic separation membranes 10, and eleven ceramic separation membranes 10 are stored in the partition pack B. Moreover, the partition pack B is placed on the partition pack A storing the ceramic separation membranes 10, and ten ceramic separation membranes 10 are stored in the partition pack A. In this way, as illustrated schematically in FIG. 10, it is possible to store a total of 42 in the placed partition packs A and B.

The box main body 2*a* storing the ceramic separation membranes 10 is fitted with a lid 2*b* of the packaging box as illustrated in FIG. 11. As illustrated in FIG. 12, the two are bound by the binding means 5 or the like to obtain a packaged item storing the ceramic separation membranes 10. The binding means 5 includes, for example, a band, a tape, a string, a cord, a rope, and the like. In addition the material of the binding means 5 is not particularly limited, and examples thereof include natural fibers, synthetic fibers, and resin-made molded articles.

The packaged item obtained above can be stored in an outer box stacked in four stages, for example. The outer box is then stacked in two stages, stored in a wooden box or the like, and preserved and transported. The means of transportation is not particularly limited, but may be, for example, transportation by ship after loading in a container or the like.

Hereinafter, the present invention is further described with reference to Examples, but the scope of the present invention is not limited by these Examples.

EXAMPLES

Forty-two ceramic separation membranes, each having a diameter D of 16.6 mm and a length of 1250 mm, are packaged in a package body. The partition pack A is a corrugated fiberboard having a length of 1300 mm, a width of 310 mm, and a thickness of 17 mm, and has 11 storing parts, with intervals therebetween in the width direction, which are through holes each having a length of 1250 mm and a width of 17 mm. The width of the partition wall between adjacent storing parts is 10 mm. The storing parts at both ends have 10-mm and 13-mm wall portions between the ends in the width direction.

The partition pack B is a corrugated fiberboard having a length of 1300 mm, a width of 310 mm, and a thickness of 17 mm, and has 10 storing parts, with intervals therebetween in the width direction, which are through holes each having a length of 1250 mm and a width of 17 mm. The width of the partition wall between adjacent storing parts is 10 mm. The storing parts at both ends have 24-mm and 26-mm wall portions between the ends in the width direction. Thus, when the partition packs A and B are placed on each other, the center lines of the storing parts of the partition pack A and the center lines of the storing parts of the partition pack B are arranged at equal intervals of 13.5 mm in the width direction.

The prepared main body 2*a* of the packaging box was 1315 mm in length, 315 mm in width, 70 mm in height, and 10 mm in thickness in inner dimensions, and was made of a corrugated fiberboard.

The partition pack A was placed at the bottom of the main body 2*a* of the packaging box, and eleven ceramic separation membranes were stored in the storing parts. The partition pack B was placed on the partition pack A in the box main body 2*a,* and ten ceramic separation membranes were stored in the storing parts. Next, the partition pack A was placed on the partition pack B in the box main body 2*a,* and eleven ceramic separation membranes were stored in the storing parts. Moreover, the partition pack B was placed on the partition pack A in the box main body 2*a,* and ten ceramic separation membranes were stored in the storing parts. As a result, 42 ceramic separation membranes were stored in the main body 2*a* of the packaging box. The main body 2*a* of the packaging box was covered with the lid 2*b* of the packaging box, which were bound with two polypropylene bands to obtain a packaged item storing ceramic separation membranes. The weight of the obtained packaged item was about 10 kg, which was a weight that could be easily transported by a worker.

The obtained packaged item was stacked in four stages, which were placed in an outer box made of corrugated fiberboard, sealed with adhesive tapes, and bound with two polypropylene bands. The outer box has a total of 168 ceramic separation membranes stored therein. In a state where 168 ceramic separation membranes were stored in the outer box, the outer box was loaded on the trunk of a passenger car, and a transportation test of about 600 km was performed. After this transportation test was finished, the packaging box was taken out of the outer box, and ten ceramic separation membranes stored in the upper partition packs B were sequentially taken out of the packaging box. After that, the partition packs B was removed, and eleven ceramic separation membranes stored in the partition packs A were sequentially taken out. Similarly, twenty-one ceramic separation membranes were sequentially taken out of the lower partition packs B and A. It was confirmed that all of the 168 ceramic separation membranes were not damaged. In addition, it was confirmed that the work efficiency was greatly improved and the damage to the ceramic separation membranes was small as compared with a conventional packaging operation of rolling and boxing ceramic separation membranes.

EXPLANATION OF REFERENCE NUMERALS

1 package body for ceramic separation membrane
2*a* main body of packaging box
2*b* lid of packaging box
3 storing part
4 partition wall
5 binding means
10 ceramic separation membrane
A partition pack A
B partition pack B
D diameter of ceramic separation membrane
W width of storing part
w width of partition wall

The invention claimed is:

1. A package body for ceramic separation membranes, comprising:

a packaging box which stores a plurality of ceramic separation membranes in parallel in a width direction and a height direction; and at least first and second partition packs, wherein each of the first and second partition packs has a thickness equal to or larger than a thickness of each of the ceramic separation membranes, and has a plurality of storing parts, with intervals therebetween in the width direction, which are rectangular through holes of a simple-shaped projection shape of the ceramic separation membrane and penetrating from the upper surface to the bottom surface of the partition packs, and the packaging box stores the at least first and second partition packs stacked in the height direction with the plurality of storing parts arranged in the width direction in a staggered manner, the ceramic separation membrane is a cylindrical separation membrane having a diameter of D, and each of the intervals between the plurality of storing parts arranged substantially parallel to the width direction is D/2 or more and D or less, and the partition packs are disposed stacked vertically, in which a lower end of the storing parts of the partition packs in an upper position is at a higher position than an upper end of the storing parts of the partition packs in a lower position, wherein n is the number of storing parts of the first partition pack placed at a bottom of the packaging box, and n−1 is the number of storing parts of the second partition pack placed on the first partition pack, wherein center lines of the storing parts of the first partition pack and center lines of the storing parts of the second partition pack are arranged at substantially equal spacing in the width direction, wherein center lines of the intervals of the first partition pack and center lines of the intervals of the second partition pack are arranged at substantially equal spacing in the width direction, and wherein the center lines of the storing parts in the first partition pack are arranged to align with the center lines of the intervals of the second partition pack between the storage parts of the second partition pack such that openings of the rectangular through holes in the first partition pack overlap with openings of the rectangular through holes in the second partition pack along a longitudinal direction.

2. The package body for ceramic separation membranes according to claim 1, wherein the first partition pack is placed at an odd-numbered stage and the second partition pack is placed at an even-numbered stage counted from the bottom of the packaging box.

3. A packaged item comprising: a plurality of ceramic separation membranes stored in the package body for ceramic separation membranes according to claim 1, wherein the ceramic separation membranes adjacent in the width direction and the height direction are arranged to avoid contact with each other.

4. The package item according to claim 3, wherein the first partition pack is placed at an odd-numbered stage and the second partition pack is placed at an even-numbered stage counted from the bottom of the packaging box.

5. The package body for ceramic separation membranes according to claim 1, wherein, the ceramic separation membranes have a maximum diameter portion and a width of the through holes in the width direction is formed to be a size that is equal to or larger than the diameter of the maximum diameter portion of the ceramic separation membranes.

6. The package body for ceramic separation membranes according to claim 1, wherein the partition packs are made of corrugated fiberboard.

7. The package body for ceramic separation membranes according to claim 5, wherein the partition packs are made of corrugated fiberboard.

8. A packaged item comprising: a plurality of ceramic separation membranes stored in the package body for ceramic separation membranes according to claim 5, wherein the ceramic separation membranes adjacent in the width direction and the height direction are arranged to avoid contact with each other.

* * * * *